US008087805B2

(12) United States Patent
Lanz

(10) Patent No.: US 8,087,805 B2
(45) Date of Patent: Jan. 3, 2012

(54) MOTOR-DRIVEN, HEAD-DISPLACEABLE FLOODLIGHT UNIT

(76) Inventor: Rüdiger Lanz, Simmertal (DE)

( * ) Notice: Subject to any disclaimer, the term of this patent is extended or adjusted under 35 U.S.C. 154(b) by 345 days.

(21) Appl. No.: 12/144,064

(22) Filed: Jun. 23, 2008

(65) Prior Publication Data

US 2009/0190347 A1 Jul. 30, 2009

(30) Foreign Application Priority Data

Jan. 25, 2008 (DE) ..... 10 2008 006 249

(51) Int. Cl.
*F21V 7/00* (2006.01)

(52) U.S. Cl. ..... 362/302; 362/247; 362/298; 362/800

(58) Field of Classification Search ..... 362/231, 362/800, 235, 227, 243, 249.02, 296.09, 362/311.02, 311.11, 298, 301–303, 247
See application file for complete search history.

(56) References Cited

U.S. PATENT DOCUMENTS

| | | | | |
|---|---|---|---|---|
| 4,894,760 | A * | 1/1990 | Callahan | 362/293 |
| 5,806,955 | A * | 9/1998 | Parkyn et al. | 362/612 |
| 7,125,144 | B2 * | 10/2006 | Shimaoka et al. | 362/243 |
| 7,494,228 | B2 * | 2/2009 | Harbers et al. | 362/231 |

* cited by examiner

*Primary Examiner* — Stephen F Husar
(74) *Attorney, Agent, or Firm* — Lowe Hauptman Ham & Berner, LLP

(57) ABSTRACT

A motor-driven, displaceable-head floodlight unit according to one or more embodiments is described. The floodlight unit is arranged to generate a plurality of light and projection effects used in stagecraft and performances, at least several LED sources being configured as the source of light in the floodlight unit. The light emission from several LED sources is collected by at least one first mirror and deflected to a second mirror. The second mirror is arranged to collimate the light from the first mirror incident thereon and transmit the light.

20 Claims, 2 Drawing Sheets

MOTOR-DRIVEN, HEAD-DISPLACEABLE FLOODLIGHT UNIT

RELATED APPLICATIONS

The present application is based on, and claims priority from German Application Number 10 2008 006 249.9, filed Jan. 25, 2008, the disclosure of which is hereby incorporated by reference herein in its entirety.

FIELD

The present invention relates to a motor-driven floodlight unit fitted with a displaceable head with which to generate a plurality of light and projection effects in particular regarding stagecraft and other performances, also to architectural illuminating means.

BACKGROUND

Known displaceable-head floodlight units (moving lights or moving heads) employ gas discharge lamps as their intensive light sources and provide a plurality of color and pattern effects implemented by color filters and by stamped out metal stops (so-called gobos) mounted on motor-driven plates and displaceable into the light path. In this manner many color and pattern combinations are feasible.

As regards conventionally used light sources, for instance high intensity discharge lamps of 250 to 1,200 watts, cooling said lamps is mandatory on account of their large heat dissipation. In general a controlled blower system will be required, entailing the drawback that dust and other contaminant particles sucked into the blower airflow quickly shall soil the inside of the floodlight unit, in turn requiring cumbersome cleaning in particular of the optical components.

In general the gas discharge lamps suffer from the drawback of short service life and also reduced output with time, requiring in general premature replacement of such light sources.

BRIEF DESCRIPTION OF THE DRAWINGS

The details of one or more embodiments are set for the in the accompanying drawings and the descriptions below.

DETAILED DESCRIPTION

Figure 1:
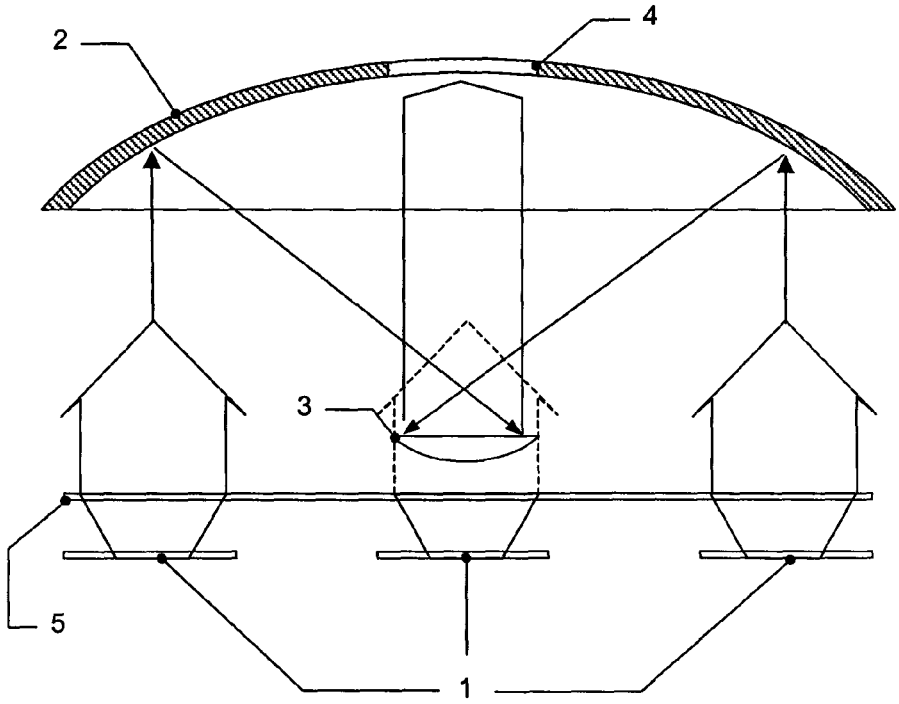
FIG. 1 is a sectional side view of an example floodlight unit according to some embodiments.

In the view of this background, it is the object of the present invention to create a motor-driven, displaceable-head floodlight unit used to generate a plurality of light and projection effects in particular as regards performances, stage craft and architectural illumination, said floodlight unit being fitted with a low-maintenance light source of long service life and constant light output.

This problem is solved in the present invention by a motor driven, displaceable-head floodlight unit defined by the features of claim 1.

The dependent claims define advantageous further embodiments of this floodlight unit.

The problem of the invention is solved by a motor-driven, displaceable-head flood unit generating a plurality of light and projection effects to be used in stagecraft and other performances, the floodlight unit comprising at least several LED sources transmitting their light beams to at least one first mirror and then being deflected by a second mirror, this second mirror collimating the light incident on it from the first mirror and transmitting it in turn.

This configuration allows collimating the broad light beam from the individual LED sources by means of the first mirror in a first stage and to collimate said light beam from several light sources using a second mirror in a manner that it shall be superposed in ideal manner and results in an intensive light beam. In this manner substantially higher light intensity is attained than would be the case arraying the LED sources on a planar surface, each LED generating a light beam parallel to the floodlight unit axis.

In this manner LED sources may be efficiently used as high intensity floodlights that heretofore were operated using gas discharge lamps. This new application of LED sources provide these floodlights with the inherent advantages of LED sources. Such advantages include the present longer service life of the LED sources compared to the gas discharge lamps while also being less energy-intensive at constant light output. The advantages so attained make evident the large possibilities offered by this new application.

Another substantial is that following operating failure, for instance due to power failure, the floodlight unit of the invention is able to resume operation instantly. Heretofore great difficulties were encountered—for instance regarding a stage performance—in that the gas discharge lamp floodlight units could resume full operation only after a delay following power resumption.

Lastly the light source unit of the present invention offers the manifest advantage of dissipating less heat, as a result of which the previous cooling procedure entailing soiling can be dropped and replaced by external cooling.

In an advantageous embodiment of the present invention, the first mirror is a parabolic mirror collimating the light beams from several LED sources. In this way the LED sources may be arrayed in a manner to emit light approximately parallel to the floodlight unit's light beam which is captured by the parabolic mirror acting like a lamp shade and collimating it toward a second mirror which in turn deflects the light into the required direction and focuses it again.

The LED sources appropriately are configured approximately symmetrically distributed around the axis of the floodlight unit. In this manner all light sources contribute an equal intensity to the subsequent light beam and the light spot is cross-sectionally of uniform intensity.

In an especially advantageous embodiment of the present invention, the first mirror is configured opposite the LED sources symmetrically arrayed around the floodlight unit axis and in this manner it reflects the LED source's light beams that thereby are incident on the second mirror mounted approximately centrally relative to the said light axis, this second mirror in turn deflecting this light in collimated manner through an aperture in the opposite first mirror. This design is preferred on account of the above discussion because offering a symmetric array of light sources around the floodlight unit axis and ensuring thereby the ultimate uniform light intensity. Such a preferred design comprises for instance eight circularly arrayed LED sources.

The LED sources already emit light in the direction of the beam axis and in the direction of the ultimate floodlight beam, the first parabolic mirror being configured opposite and approximately perpendicularly to the light axis. The light reflected by this first parabolic mirror is collimated at a point situated centrally between the LED sources approximately in the light axis and is incident at that site on the second mirror appropriately also a parabolic mirror to eliminate a second condenser lens. Accordingly this second mirror already transmits the actual floodlight beam which is then directed through further stops, filters and/or lens elements to attain the desired light effects.

The LED sources advantageously shall be LED chips, a condenser lens being associated with each LED source and collimating the light received at the first mirror or the lens element array. In this manner the emitted light is collimated already when incident on the first mirror and the full light output is utilized.

To focus the light beam, the first mirror and/or the second mirror are appropriately configured in the floodlight unit. The mirror(s) is/are displaced along the light axis for that purpose. The desired adjustment may be manual or motor-driven.

Another advantageous embodiment of the floodlight unit of the present invention configures at least the LED sources of the three primary colors red, blue, green (RBG) in the floodlight unit. Using these three primary colors, arbitrary color effects implemented by color synthesis may be generated, the LED sources of different colors being matched to each other with respect to their light intensities. In this manner a floodlight unit with smoothly changing color effects may be implemented without the need for complex/expensive color filtering mechanisms as has been the case heretofore with conventional stage floodlight units.

Advantageously too at least one of the LED sources exhibits the color amber to allow good mixing of the heat of the ultimate light beam, in particular when generating the color white.

Accordingly new space is made available on the new floodlight unit for instance for additional effect stops and the like. Also, the heretofore conventional color filters entailing a loss of light, the light previously lost now is available because the stops may be eliminated.

In an idealized design, therefore, the LED sources are LED chips each already containing the RGB colors, so that each LED chip per se may emit a desired mixture of colors. Consequently the generated color spot reliably provides a uniform color hue at all sites.

The central problem in cooling is appropriately ameliorated by a design wherein at least the LED sources, the first lens elements and the reflector respectively the reflector surfaces are configured in an aluminum housing that is cooled by a radiator outside the spotlight unit housing. Because of its high thermal conductivity, aluminum is ideally well suited for the desired heat transfer by said housing while simultaneously being lightweight; a lower weight is a pertinent consideration because the floodlight unit head should be lightweight to meet high mobility requirements.

In a further advantageous feature of the present invention, the rear side of said housing shall be fitted with cooling fins imparting a larger surface to it and hence attaining accelerated temperature equilibrium.

An illustrative embodiment mode of the present invention is elucidated below in relation to several appended drawings.

Figure 2:
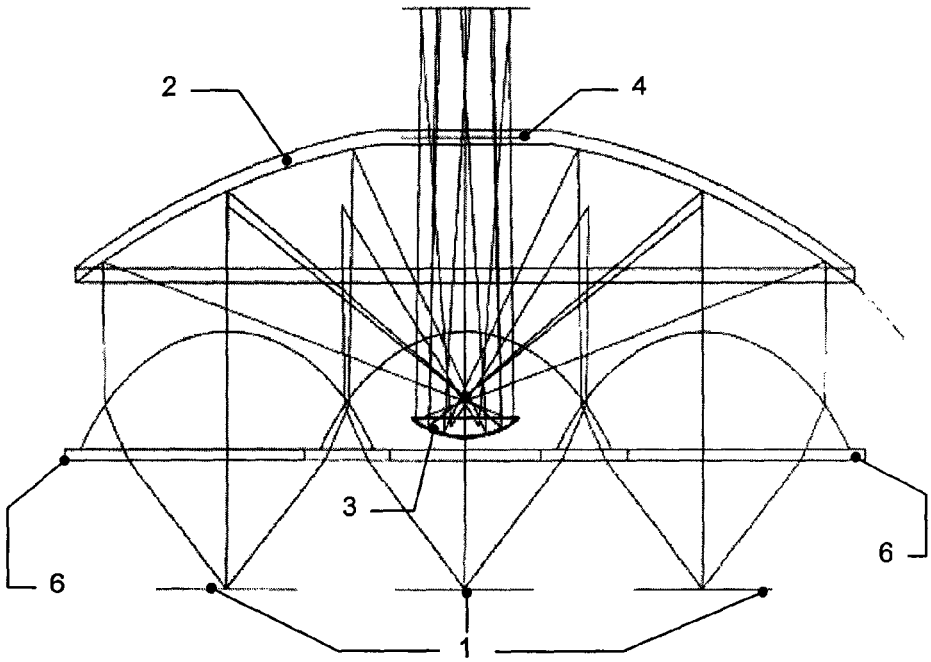
FIG. 2 is a sectional side view of another example floodlight unit according to some embodiments.

FIGS. 1, 2 each show a sectional side view of a section of a first mirror 2 designed as a parabolic mirror.

The LED sources 1 are LED chips mounted for instance on the back wall of the floodlight unit housing and already emitting their light in the ultimate light beam axis of the floodlight unit. The LED light is collimated by lens elements configured as single elements 6 or as lens element arrays 5 associated with the LED sources 1.

This collimated light is incident on the first mirror 2 which reflects and collimates it at a central site between the LED sources 1. At this site the second mirror 3 also is parabolic and in turn generates a collimated light beam running along the optic axis of the floodlight unit.

Said collimated light beam traverses the first mirror 2 at a central aperture 4 and is guided as desired by subsequent effect-generating devices such as stops and filters.

Figure 3:
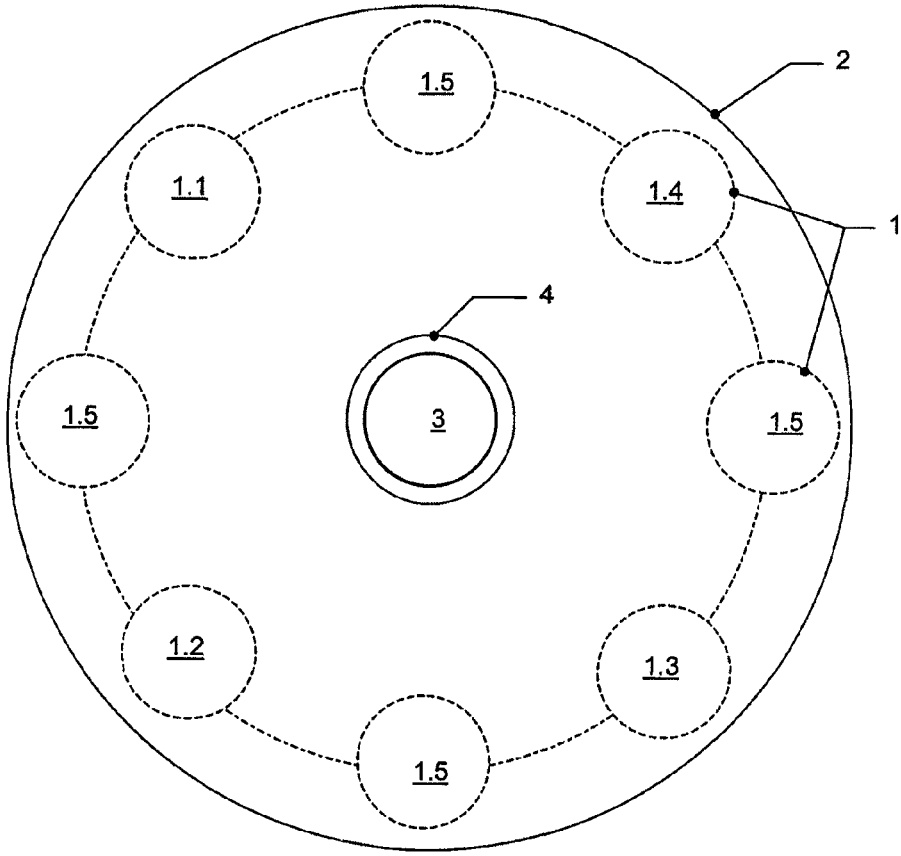
FIG. 3 shows an annular configuration of the LED light sources according to some embodiments.

FIG. 3 shows an appropriate annular configuration of the LED sources around the central aperture 4 in the first mirror 2. The second mirror 3 is mounted underneath the aperture 4.

The shown advantageous embodiment mode discloses a configuration of LED sources emitting different colors, and an LED source 1.1 having the RGB color red, an LED source 1.2 having the RGB color green, an LED source 1.3 having the RGB color blue, an LED source 1.4 having the color amber and LEC source having 1.5 the color white.

An alternative embodiment mode uses LED sources of which the above cited colors are present already on a chip, as a result of which each chip per se is able to generate the precise color mixture needed at the time, such mixture not being generated by mixing LED sources of different colors.

The invention claimed is:

1. A floodlight unit for emitting a light beam along a beam axis, the floodlight unit comprising:

a plurality of light-emitting-diode (LED) light sources arranged around the beam axis of the floodlight unit;

a first mirror having an aperture formed therein and positioned opposite the LED light sources; and a second mirror positioned to coincide with said beam axis, the first mirror being configured to reflect light emitted from said LED light sources to the second mirror, and said second mirror being arranged for collimating the reflected light directly from the first mirror and forming the light beam by directing the collimated light through the aperture of the first mirror.

2. The floodlight unit as claimed in claim 1, wherein the first mirror is designed as a parabolic mirror collimating the light emitted from the LED light sources.

3. The floodlight unit as claimed in claim 1, wherein the LED light sources are configured to emit light in a manner approximately parallel to the said floodlight unit's light beam.

4. The floodlight unit as claimed in claim 1, wherein the LED light sources are approximately distributed symmetrically about the floodlight unit's beam axis.

5. The floodlight unit as claimed in claim 1, wherein the second mirror is a parabolic mirror collimating the lights emitted by several LED light sources.

6. The floodlight unit as claimed in claim 1, wherein LED chips are used as the LED light sources each of which is associated with a condenser lens collimating the light incident on the first mirror.

7. The floodlight unit as claimed in claim 1, wherein LED chips are used as the LED light sources, the floodlight unit further comprising a lens array configured to collimate the light incident on the first mirror.

8. The floodlight unit as claimed in claim 1, wherein the first mirror and the second mirror are mounted in displaceable manner in the floodlight unit.

9. The flood light unit as claimed in claim 1, wherein the LED light sources are capable of emitting light in red, green, and blue colors to enable the floodlight unit to generate predetermined mixtures of colors.

10. The floodlight unit as claimed in claim 1, wherein at least one of the LED light sources generates the color hue amber.

11. The floodlight unit as claimed in claim 1, wherein LED chips are used as the LED light sources, each said chip is capable of emitting light in red, green, and blue colors for allowing the chip to transmit a predetermined mixture of colors.

12. The floodlight unit as claimed in claim 1, wherein eight LED light sources are symmetrically configured about the floodlight unit's beam axis.

13. A floodlight unit for emitting a light beam along a beam direction, the floodlight unit comprising:

a plurality of light-emitting-diode (LED) light sources configured to emit light;

a collimating mirror; and at least one reflecting mirror positioned for receiving and reflecting the light emitted by the plurality of LED light sources toward the collimating mirror, the collimating mirror being arranged for directing the reflected light directly from the at least one reflecting mirror to form the light beam along the beam direction.

14. The floodlight unit of claim 13, wherein the at least one reflecting mirror is a parabolic mirror having an aperture defined therein.

15. The floodlight unit of claim 13, wherein the collimating mirror is a parabolic mirror.

16. The floodlight unit of claim 13, wherein the LED light sources comprises at least a red light source, at least a green light source, and at least a blue light source.

17. A floodlight unit for emitting a light beam along a beam axis, the floodlight unit comprising:

a plurality of light-emitting-diode (LED) light sources configured to emit light;

a collimating mirror positioned to coincide with the beam axis; and at least one reflecting mirror arranged to define an aperture and positioned for receiving and reflecting the light emitted by the plurality of LED light sources toward the collimating mirror, the collimating mirror is arranged for directing the reflected light directly from the at least one reflecting mirror to the aperture in order to form the light beam along the beam axis.

18. The floodlight unit of claim 17, wherein the at least one reflecting mirror is a parabolic mirror having the aperture defined therein.

19. The floodlight unit of claim 17, wherein the collimating mirror is a parabolic mirror.

20. The floodlight unit of claim 17, wherein the LED light sources comprises at least a red light source, at least a green light source, and at least a blue light source.

* * * * *